US005199858A

United States Patent [19]

Tsuboi et al.

[11] Patent Number: 5,199,858

[45] Date of Patent: Apr. 6, 1993

[54] OIL INJECTION TYPE SCREW COMPRESSOR

[75] Inventors: Noboru Tsuboi, Kakogawa; Masaki Matsukuma, Kobe; Kazuo Kubo, Kobe; Terumasa Kume, Kobe; Tsuyoshi Niimura, Kakogawa; Atsushi Ikeda, Kobe, all of Japan

[73] Assignee: Kabushiki Kaisha Kobe Seiko Sho, Kobe, Japan

[21] Appl. No.: 735,281

[22] Filed: Jul. 24, 1991

[30] Foreign Application Priority Data

Aug. 31, 1990 [JP] Japan ..... 2-232187
Nov. 5, 1990 [JP] Japan ..... 2-300418

[51] Int. Cl.[5] ..... F04B 39/02

[52] U.S. Cl. ..... 417/362; 418/98; 418/DIG. 1

[58] Field of Search ..... 418/DIG. 1, 97, 98, 418/99; 417/362

[56] References Cited

U.S. PATENT DOCUMENTS 1,626,768 5/1927 Vollman ..... 418/98
2,253,859 8/1941 Mantle ..... 417/362 X
2,826,354 3/1958 Field ..... 417/362 X
3,016,184 1/1962 Hart ..... 418/DIG. 1
5,022,827 6/1991 Gargas ..... 417/362

FOREIGN PATENT DOCUMENTS 379011 7/1990 European Pat. Off. ..... 417/362
203599 10/1983 German Democratic Rep. ..... 418/DIG. 1

*Primary Examiner*—Leonard E. Smith
*Attorney, Agent, or Firm*—Oblon, Spivak, McClelland, Maier & Neustadt

[57] ABSTRACT

An oil injection type screw compressor which includes an oil tank for separating lubricating oil from gas discharged from a compressor body and collecting the thus separated lubricating oil is constituted such that the oil tank has a substantially L-shaped vertical section composed of a base portion and a column portion provided uprightly on the base portion such that a spacing in the base portion located above an oil storage portion at a lower location in the base portion is formed such that it extends from an upper portion in the base portion to the inside of the column portion, and an oil separating element is provided on the inner side of an exit of gas at an upper portion of the column portion while the compressor body is disposed on the base portion.

4 Claims, 8 Drawing Sheets

OIL INJECTION TYPE SCREW COMPRESSOR

FIELD OF THE INVENTION

This invention relates to an oil injection type screw compressor having an oil tank for separating lubricating oil from gas discharged from a compressor body and collecting the thus separated lubricating oil.

BACKGROUND OF THE INVENTION

Conventionally, oil injection type screw compressors are employed in various field and are still undergoing various improvements. Such improvements are directed, in addition to improvement in performance, to reduction of an occupied area and also of a size of an equipment and reduction in noise production. When it is intended to reduce the occupied area of an equipment, it is a possible resolution to employ a vertical arrangement wherein various components of an equipment, which are conventionally disposed in a plane, are otherwise disposed vertically one on another. For example, an arrangement is already known wherein a compressor body is disposed on a oil tank. Such arrangement is disclosed, for example, in Japanese Utility Model Publication Application No. 54-37444 or Japanese Utility Model Publication Application No. 52-54009.

While the occupied area of an equipment can be reduced by arranging a compressor body on an oil tank as described just above, such mere arrangement of various components in a vertical direction does not present any change of the volume occupied as a whole by the equipment. Accordingly, there remains a problem that reduction in size of the equipment is not achieved sufficiently by the solution.

SUMMARY OF THE INVENTION

Accordingly, an essential object of the present invention is to provide oil injection type screw compressors which eliminate the above described disadvantages inherent in such conventional apparatus.

In accomplishing these and other objects, according to one preferred embodiment of the present invention, there is provided an oil injection type screw compressor which includes an oil tank for separating lubricating oil from gas discharged from a compressor body and collecting the thus separated lubricating oil, characterized in that the oil tank has a substantially L-shaped vertical section composed of a base portion and a column portion provided uprightly on the base portion such that a spacing in the base portion located above an oil storage portion at a lower location in the base portion is formed such that it extends from an upper portion in the base portion to the inside of the column portion, and an oil separating element is provided on the inner side of an exit of gas at an upper portion of the column portion while the compressor body is disposed on the base portion.

With the construction described above, when air bubbles are produced in lubricating oil in the oil storage portion, for example, upon starting of the compressor and raise the surface of the oil, since the oil separating element is spaced away from the oil surface, it is not dipped with the lubricating oil and accordingly maintains its normal oil separating function. Besides, a great area can be assured for the oil surface to promote deairing and a rise of the oil surface can be restricted. Further, since the compressor body is disposed in a spacing produced by reducing the height of a portion of the oil tank other than the oil separating element, the screw compressor is formed as a generally compact equipment.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
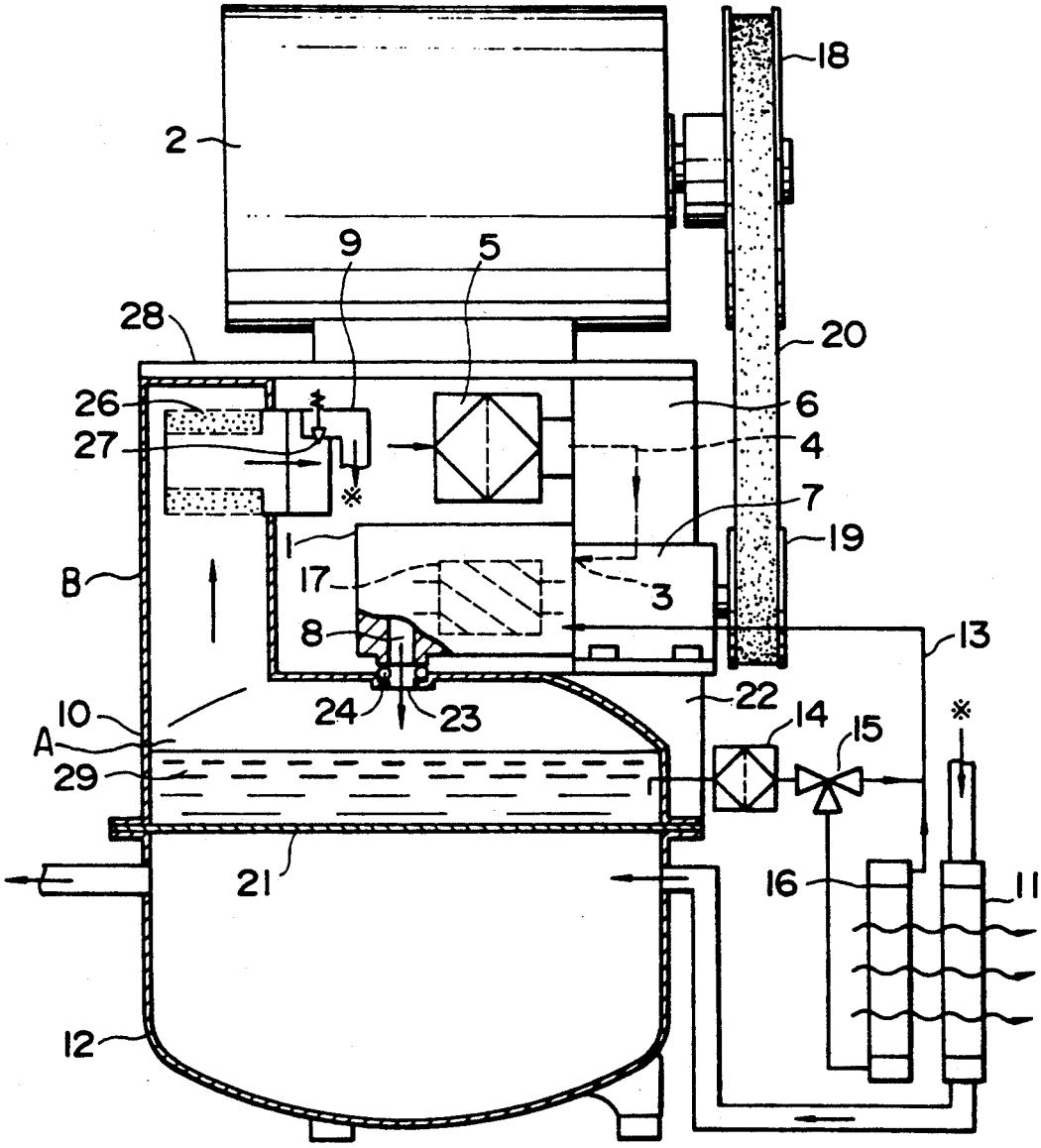
FIG. 1 is a schematic vertical sectional view of an oil injection type screw compressor according to a first embodiment of the present invention.

Before the description of the present invention proceeds, it is to be noted that like parts are designated by like reference numerals throughout the accompanying drawings.

Subsequently, an embodiment of the present invention will be described with reference to the drawings.

FIG. 1 shows an oil injection type screw compressor according to a first embodiment of the present invention. The oil injection type screw compressor shown includes a compressor body 1 and a motor 2. The oil injection type screw compressor further includes an inlet filter 5, an inlet air control valve 6 and an inlet casing 7 all provided in an inlet flow passageway 4 which connects to an inlet port 3 of the compressor body 1. The oil injection type compressor further includes an oil tank 10, an after cooler 11 and a reservoir tank 12 all provided in an outlet flow passageway 9 which connects to an outlet port 8 of the compressor body 1, and an oil filter 14, a three way directional control valve 15 and an oil cooler 16 all provided in a lubricating oil circulating passageway 13.

The compressor body 1 is secured to the inlet casing 7 and accommodates therein a pair of female and male screw rotors 17 which are supported for rotation by outlet side bearings not shown and inlet side bearings not shown in the inlet casing 7 and are held in meshing engagement with each other. The screw rotors 17 are connected to be driven by the motor 2 by way of a driving pulley 18, a driven pulley 19 and a belt 20. Meanwhile, the inlet air control valve 6 is secured to the inlet casing 7 while the inlet filter 5 is secured to the inlet air control valve 6 such that the inlet flow passageway is formed by mutually communicating spacings in the inlet filter 5, inlet air control valve 6 and inlet casing 7.

The oil tank 10 is composed of a base portion A and a column portion B provided uprightly on the base portion A and having a substantially L-shaped vertical section. The reservoir tank 12 is disposed below the oil tank 10, and they are formed as a unitary vessel with a partition plate 21 interposed therebetween. A receiving table 22 is provided uprightly on an outer periphery of the oil tank 10 remote from the column portion B, and an inlet opening 23 is perforated at a central portion of an upper wall of the oil tank 10. The inlet casing 7 is secured to the receiving table 22 such that the compressor body 1 is supported in a cantilever-like configuration by the inlet casing 7 and the outlet port 8 is pressed against and contacted closely with the inlet opening 23 in an isolated condition from the outside with an O-snap ring 24 interposed therebetween. Further, an oil separating element 26 is provided at an upper location of the interior of the column portion B, and the outlet flow passageway 9 is formed such that it extends from the outlet port 8 to the after cooler 11 and further to the reservoir tank 12 by way of the oil separating element 26 and a pressure maintaining check valve 27. It is to be noted that the outlet flow passageway 9 is partly omitted in FIG. 1 and portions thereof indicated by a mark * connect to each other.

The column portion B is formed such that an upper face thereof may be located at a predetermined height with respect to an upper face of the receiving table 22 while also the inlet casing 7 and inlet air control valve 6 are formed such that they are located individually at predetermined heights. Thus, only if the inlet casing 7 and inlet air control valve 6 are placed onto and secured to the receiving table 22, then an upper face of the inlet air control valve 6 and the upper face of the column portion B are aligned with each other, and the motor 2 is secured to the upper faces of the inlet air control valve 6 and column portion B with a support plate 28 interposed therebetween.

The lubricating oil circulating passageway 13 extends from an oil storage portion 29 in the base portion A to several lubricating portions such as bearings and shaft seal portions in the compressor body 1 and the inlet casing 7.

When the screw rotors 17 are driven to rotate by the motor 2 by way of the driving pulley 18, driven pulley 19 and belt 20, air is taken into the compressor body 1 from the inlet port 3 by way of the inlet filter 5 and the inlet flow passageway 4 and then compressed by the screw rotors 17. The thus compressed air is then discharged by way of the outlet port 8 together with lubricating oil which has been supplied to the bearing portions and so forth. The compressed air discharged together with the lubricating oil in this manner is introduced into the oil tank 10 and then into the outlet flow passageway 9, at which time the compressed air and the lubricating oil are separated from each other by the oil separating element 26. The thus separated lubricating oil drops from the oil separating element 26 and is stored in the oil storage portion 29 while the compressed air separated from the lubricating oil is introduced into the after cooler 11, in which the compressed air is cooled by air blown thereto by a fan (not shown). The thus cooled air is stored in the reservoir tank 12 and is then sent out from the equipment suitably in response to a request.

On the other hand, the lubricating oil at the oil storage portion 29 is then introduced to the oil cooler 16 by way of the oil filter 14 and the three way directional control valve 15. In the oil cooler 16, the lubricating oil is cooled by air blown thereto by a fan not shown, similarly as the compressed air in the after cooler 11. The thus cooled lubricating oil is then introduced to the lubricating portions in the compressor body 1 and the inlet casing 7, and after then, it is collected into the oil storage portion 29, so that it is thereafter used in a similar manner for the lubrication as described above. It is to be noted that, when lubricating oil in the oil storage portion 29 need not be passed through the oil cooler 16 such as when the temperature thereof is not so high as it is necessary to cool, the three way directional control valve 15 is changed over so that lubricating oil may be fed from the oil filter 14 directly to the lubricating portions bypassing the oil cooler 16.

Here, since the oil tank 10 and the reservoir tank 12 are formed as a unitary vessel, the entire equipment is formed compact, and lubricating oil in the oil storage portion 29 is positioned adjacent cooled compressed air in the reservoir tank 12 with the partition plate 21 interposed therebetween so that it is cooled also by such cooled compressed air.

Figure 2:
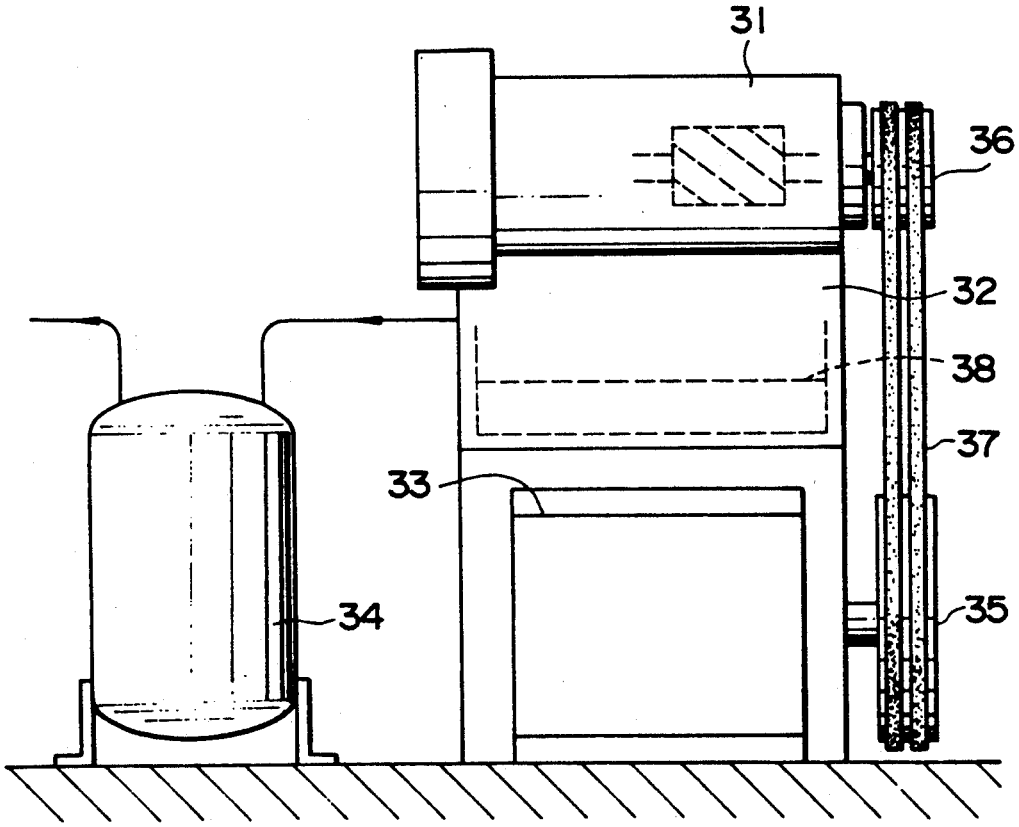
FIG. 2 PRIOR ART
FIG. 2 is a front elevational view of a conventional oil injection type screw compressor.

Such an oil injection type screw compressor as shown in FIG. 2 is already known, wherein a compressor body 31, an oil tank 32 and a motor 33 are assembled in a single unit while a reservoir tank 34 is formed and placed as a separate body.

In such conventional oil injection type screw compressor, air is taken in and compressed by the compressor body 31 which is driven by the motor 33 by way of a driving pulley 35, a driven pulley 36 and a belt 37, and the thus compressed air is discharged together with lubricating oil into the oil tank 32, in which the compressed air and the lubricating oil are separated from each other by an oil separating element (not shown). Then, the lubricating oil drops to an oil storage portion 38 at a lower location in the oil tank 32 while the air is cooled by an after cooler (not shown) and is then stored in the reservoir tank 34, from which it is sent out after then.

It is to be noted that lubricating oil in the oil storage portion 38 is cooled by an oil cooler (not shown) and is then fed to lubricating portions in the compressor body 31 again in order to circulate it.

Here, since the sizes of the oil tank 32 and the reservoir tank 34 are not reduced very much, the ratio of their sizes to that of the entire equipment is significantly high, and while the compressor body 31, oil tank 32 and motor 33 are formed as a unit, the reservoir tank 34 is formed as a separate body. In particular, the oil tank 32 must have a sufficient height to allow the oil storage portion 34 and the oil separating element (not shown) located above the oil storage portion 34 to be spaced by an appropriate distance from each other in order to achieve efficient separation of lubricating oil from compressed air. And besides, lubricating oil of an amount sufficient to allow such lubricating oil to be continuously circulated in the equipment must necessarily be assured in the oil storage portion 38. Meanwhile, the reservoir tank 34 has a size sufficient to allow the equipment to operate efficiently and to assure smooth supply of compressed air.

Generally, in designing a machine, it is an important factor, in addition to meeting of requirements for performances of an equipment, to make the entire equipment compact. Particularly, due to an influence of a significant rise of the price of land, a requirement of users for minimization of an installation space of an equipment is progressively increasing also in the field of screw compressors.

However, with such conventional screw compressor as described above, the reservoir tank 34 is installed as a separate body and occupies a significantly great spacing, and accordingly, there is a problem that it is inconvenient for use. Such problem of a spacing gets more serious as the scale of the city increases.

By the way, in the compressor of the present invention shown in FIG. 1, for example, upon starting of the compressor, air bubbles are produced in lubricating oil in the oil storage portion 29 and raise the surface of the oil. Meanwhile, in order to maintain the air-oil separating performance of the oil separating element 26, the oil separating element 26 must not be dipped with lubricating oil even when the oil surface rises as described above. Accordingly, the oil surface and the oil separating element 26 cannot be disposed very near to each other but must necessarily be spaced by a significant distance from each other. Therefore, the oil tank in the conventional equipment has a significantly great height and the equipment has a significantly great overall height. With the compressor of the present embodiment, however, since the oil separating element 26 is provided at an upper location of the spacing in the column B provided uprightly at an upper portion of the outer periphery of one side of the oil tank 10, a sufficiently great distance is assured between the oil separating element 26 and the surface of oil in the oil storage portion 29, and consequently, the remaining spacing can be utilized effectively. More particularly, a portion of the oil tank 10 other than the column portion B, that is, the base portion A, has a minimum necessary volume for the storage of lubricating oil of a sufficient amount to assure continuous circulation of lubricating oil in the equipment while a great area of the oil surface is assured to promote deairing when air bubbles are produced as described above and besides a great area is assured in a horizontal plane to reduce the height of the base portion A in order to reduce a rise of the oil surface. Thus, the compressor body 1 is disposed in a spacing which is produced by forming the oil tank 10 in such a manner as to have an L-shaped vertical section to reduce the height of the other portion of the oil tank 10 than the column portion B as described above, and the compressor body 1 is positioned between an oil separating portion 25 and the two projecting portions including the inlet casing 7 and inlet air control valve 6 to make the entire equipment compact.

Further, since the oil tank 10 has such a profile that the height is reduced and the sectional area in a horizontal direction is increased except the column portion B, if vibrations are applied to a central portion of the upper wall of the oil tank 10, then it is readily deformed and likely produces a great sound due to an action similar to a drum, but even if vibrations are applied to a peripheral portion of the oil tank 10, a noise is not likely produced because such peripheral portion has a condition nearer to a rigid body than the central portion of the upper wall. Thus, in the present embodiment, the compressor body 1 which produces vibrations and likely makes a noise source is supported on the receiving table 22 of the inlet casing 7 so that vibrations may be received at a peripheral portion of the oil tank 10 while the central portion of the upper wall of the base portion A of the oil tank 10 is held in contact with the compressor body 1 by way of the O-snap ring 24 to reduce noises.

Further, the motor 2 which likely makes a noise generating source together with the compressor body 1 is supported on the oil separating portion 25 by way of the support plate 28 and also on the receiving table 22 by way of the support plate 28, inlet air control valve 6 and inlet casing 7 so that vibrations may be propagated to the peripheral portion of the oil tank 10 similarly as described above to reduce noises.

In addition, preferably the oil tank 10 is formed from a thick plate member. In this instance, it is easy to dispose the oil separating element 26 horizontally as seen in FIG. 1 and reduce the height of the column portion B. Besides, it is also possible to effectively utilize a spacing at the side of the oil separating portion 25.

As apparent from the foregoing description, according to the present invention, there is provided an oil injection type screw compressor which includes an oil tank for separating lubricating oil from gas discharged from a compressor body and collecting the thus separated lubricating oil, characterized in that the oil tank has a substantially L-shaped vertical section composed of a base portion and a column portion provided uprightly on the base portion such that a spacing in the base portion located above an oil storage portion at a lower location in the base portion is formed such that it extends from an upper portion in the base portion to the inside of the column portion, and an oil separating element is provided on the inner side of an exit of gas at an upper portion of the column portion while the compressor body is disposed on the base portion.

Accordingly, when air bubbles are produced in lubricating oil in the oil storage portion, for example, upon starting of the compressor and raise the surface of the oil, since the oil separating element is spaced away from the oil surface, it is not dipped with the lubricating oil and accordingly maintains its normal oil separating function. Besides, a great area can be assured for the oil surface to promote deairing and a rise of the oil surface can be restricted. Further, since the compressor body is disposed in a spacing produced by reducing the height of a portion of the oil tank other than the oil separating element, there are further effects that the screw compressor is formed as a generally compact equipment and also the occupation area of the equipment can be reduced.

Figure 3:
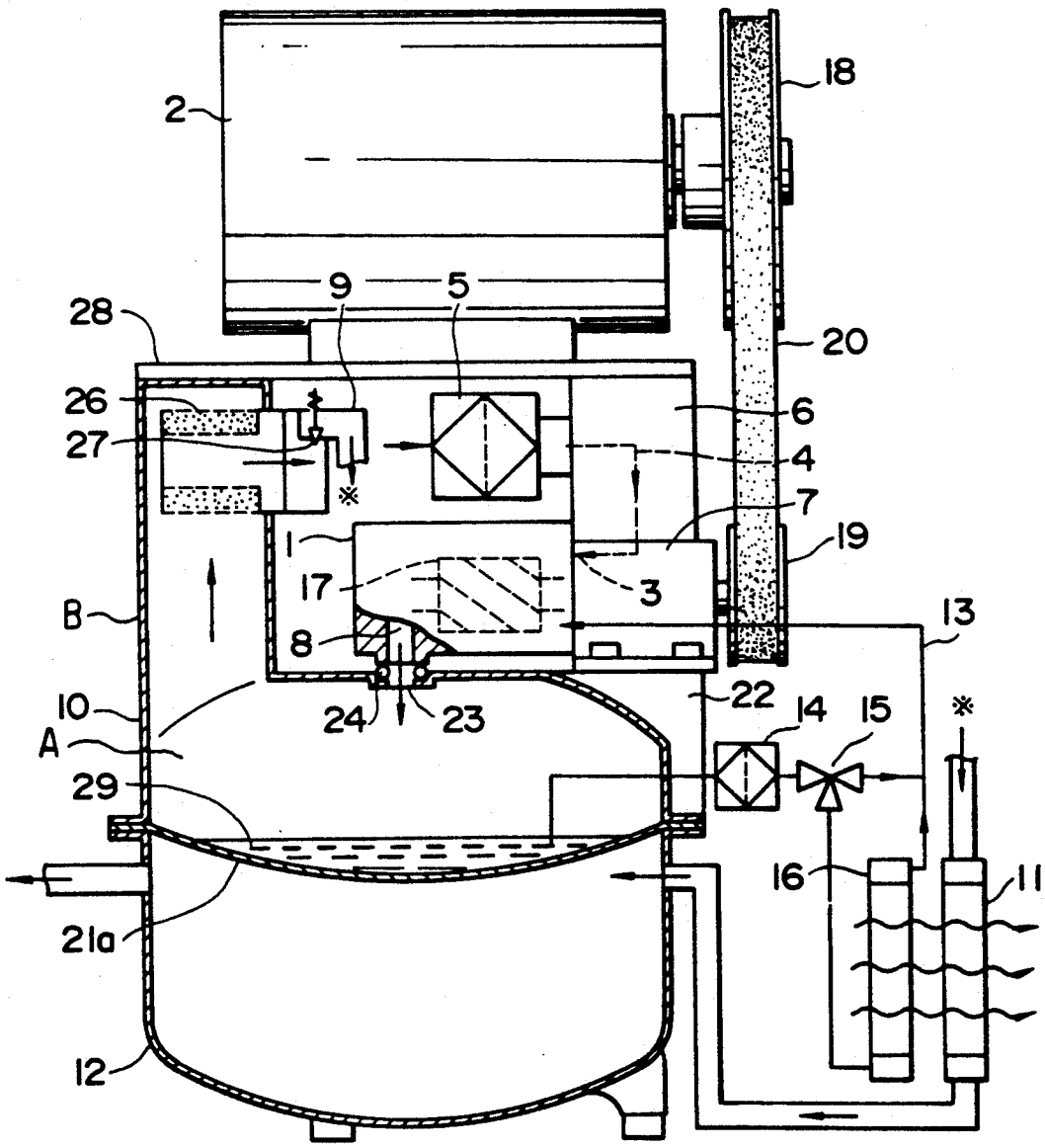
FIG. 3 is a schematic vertical sectional view of an oil injection type screw compressor according to a second embodiment of the present invention.

FIG. 3 shows an oil injection type screw compressor according to a second embodiment of the present invention. The present oil injection type screw compressor is substantially similar to the equipment of the first embodiment shown in FIG. 1 except that a partition plate **21*a* is provided in place of the partition plate 21**, and like parts are denoted by like reference numerals and description thereof is omitted herein.

Here, the partition plate **21*a*** has such an arcuate section that, in the present embodiment, it is convex or projected downwardly.

Then, when the screw compressor is in a stopped condition, the pressure in the oil tank 10 is equal to the atmospheric pressure while compressed air of a high pressure is stored in the reservoir tank 12, and in this condition, when the difference in pressure on the opposite sides of the partition plate 21*a* increases, the partition plate 21*a* can bear a higher pressure than a flat plate of the same thickness. In other words, the partition plate 21*a* can bear a same pressure difference with a smaller thickness than another partition plate in the form of a flat plate.

Further, the partition plate 21*a* has a greater horizontal sectional area in the upward direction, and even when a large amount of air bubbles are produced, for example, upon starting of the equipment, and raise the oil surface as described hereinabove, the area of the oil surface increases as the oil surface rises, and consequently, deairing is promoted and a rise of the oil surface is restricted.

Figure 4:
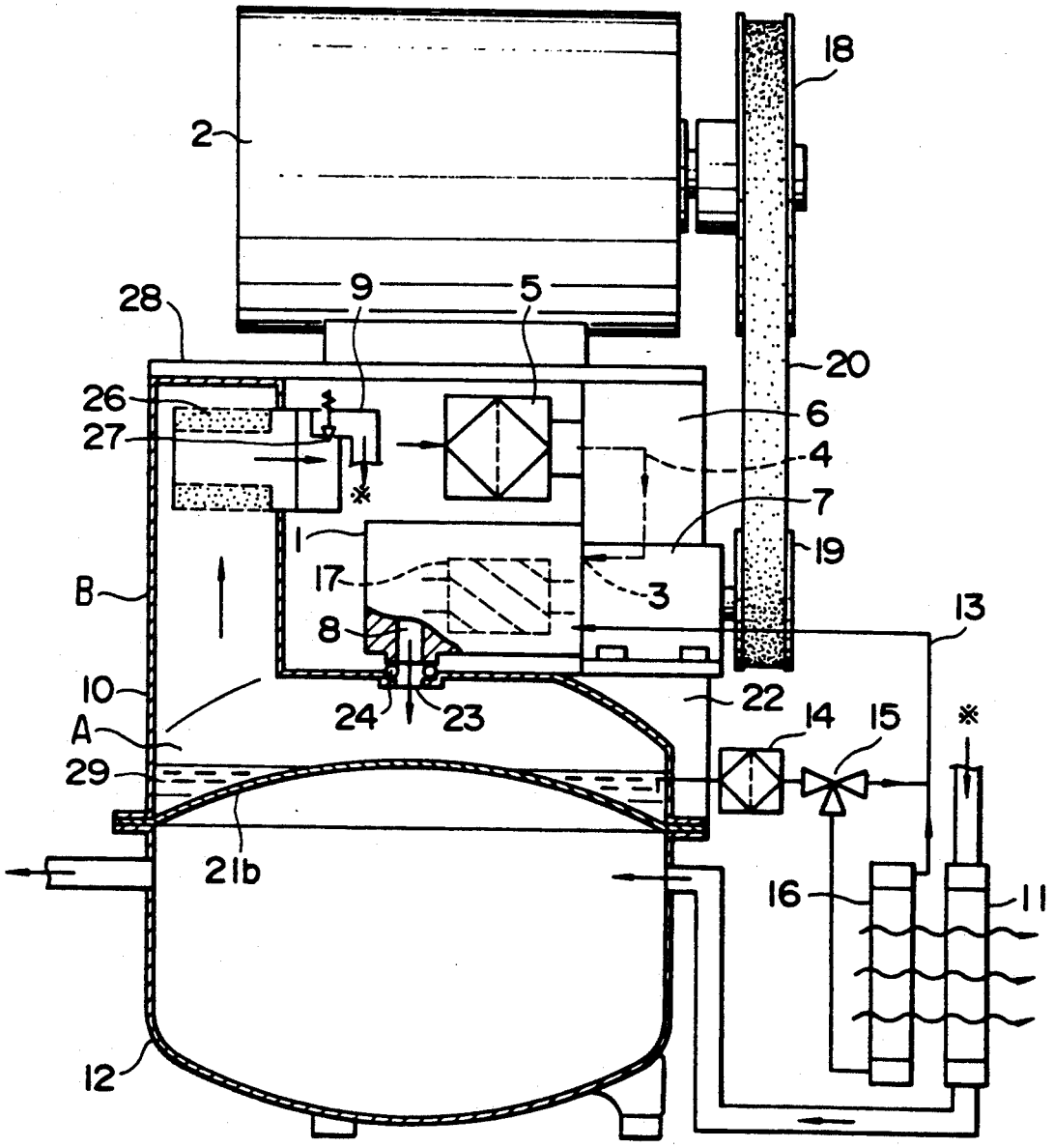
FIG. 4 is a schematic vertical sectional view of an oil injection type screw compressor according to a third embodiment of the present invention.

FIG. 4 shows an oil injection type screw compressor according to a third embodiment of the present invention. The present oil injection type screw compressor is substantially similar to the equipment of the first embodiment shown in FIG. 1 except that a partition plate 21*b* is provided in place of the partition plate 21, and like parts are denoted by like reference numerals and description thereof is omitted herein.

Here, the partition plate 21*b* is formed to have an arcuate section which is convex or projected upwardly.

Thus, the partition plate 21*b* can bear a higher pressure acting from below than another partition plate in the form of a flat plate or a plate having an arcuate section which is convex or projected downwardly, and it can be formed with a minimum thickness in order to bear a same pressure.

It is to be noted that, while in the embodiments described above the motor 2 which serves as a driving portion is shown supported on the oil separating portion 25 and the inlet casing 7 and inlet air control valve 6 by way of the supporting plate 28, the present invention is not limited to this, and the supporting portions may otherwise be supported on a platform provided uprightly around the oil tank 10 as described in the following.

Figure 5:
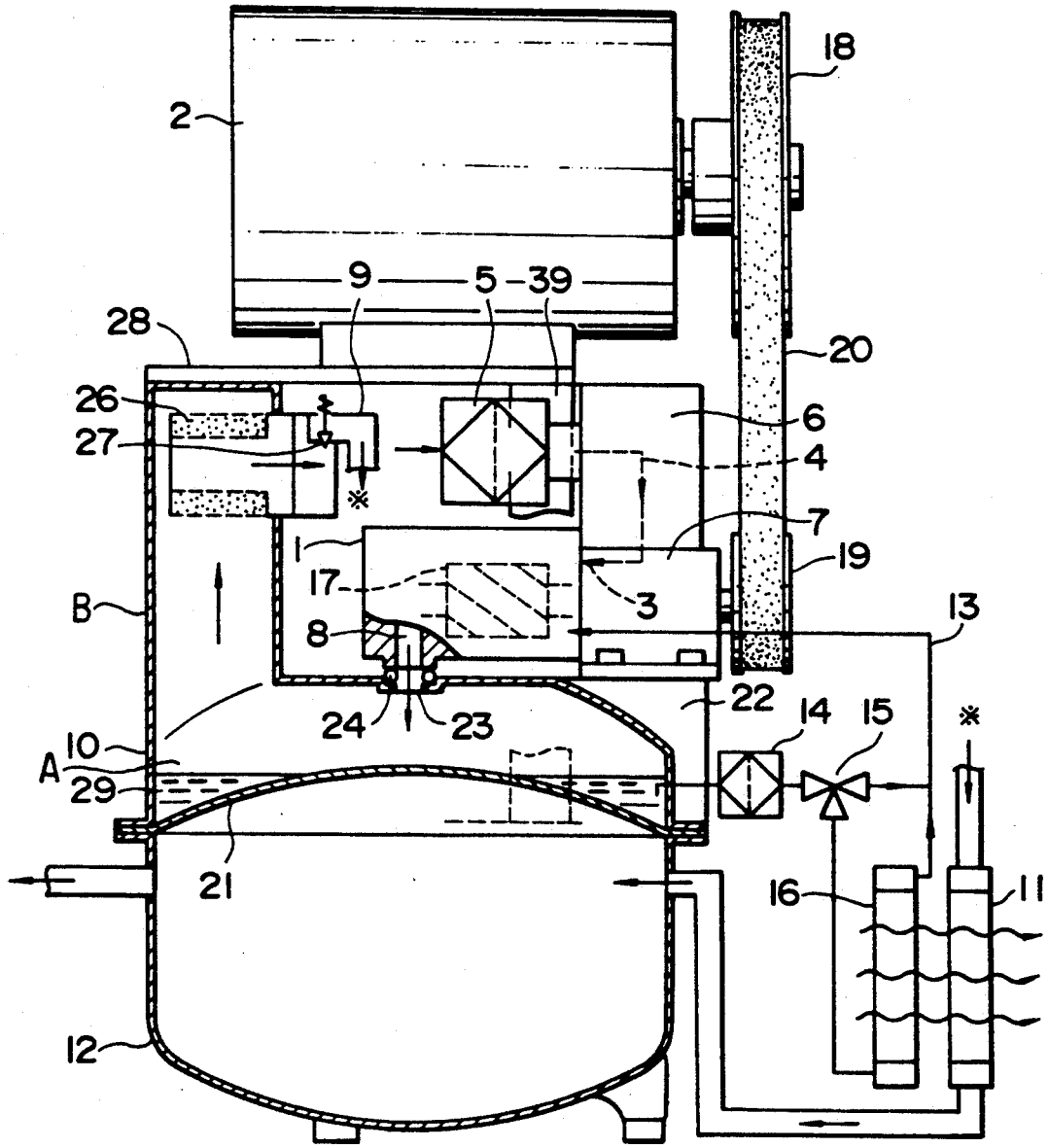
FIG. 5 is a schematic vertical sectional view of an oil injection type screw compressor according to a fourth embodiment of the present invention.

FIG. 5 shows an oil injection type screw compressor according to a fourth embodiment of the present invention. The present oil injection type screw compressor is substantially similar to the equipment according to the first embodiment shown in FIG. 1 except that a support portion for the support plate 28 is provided by a platform 39 provided uprightly on a peripheral portion of an upper face of the oil tank 10 in place of the inlet air control valve 6 and inlet casing 7 which serve as intermediate members, and like parts are denoted by like reference numerals and description thereof will be omitted herein.

Figure 6:
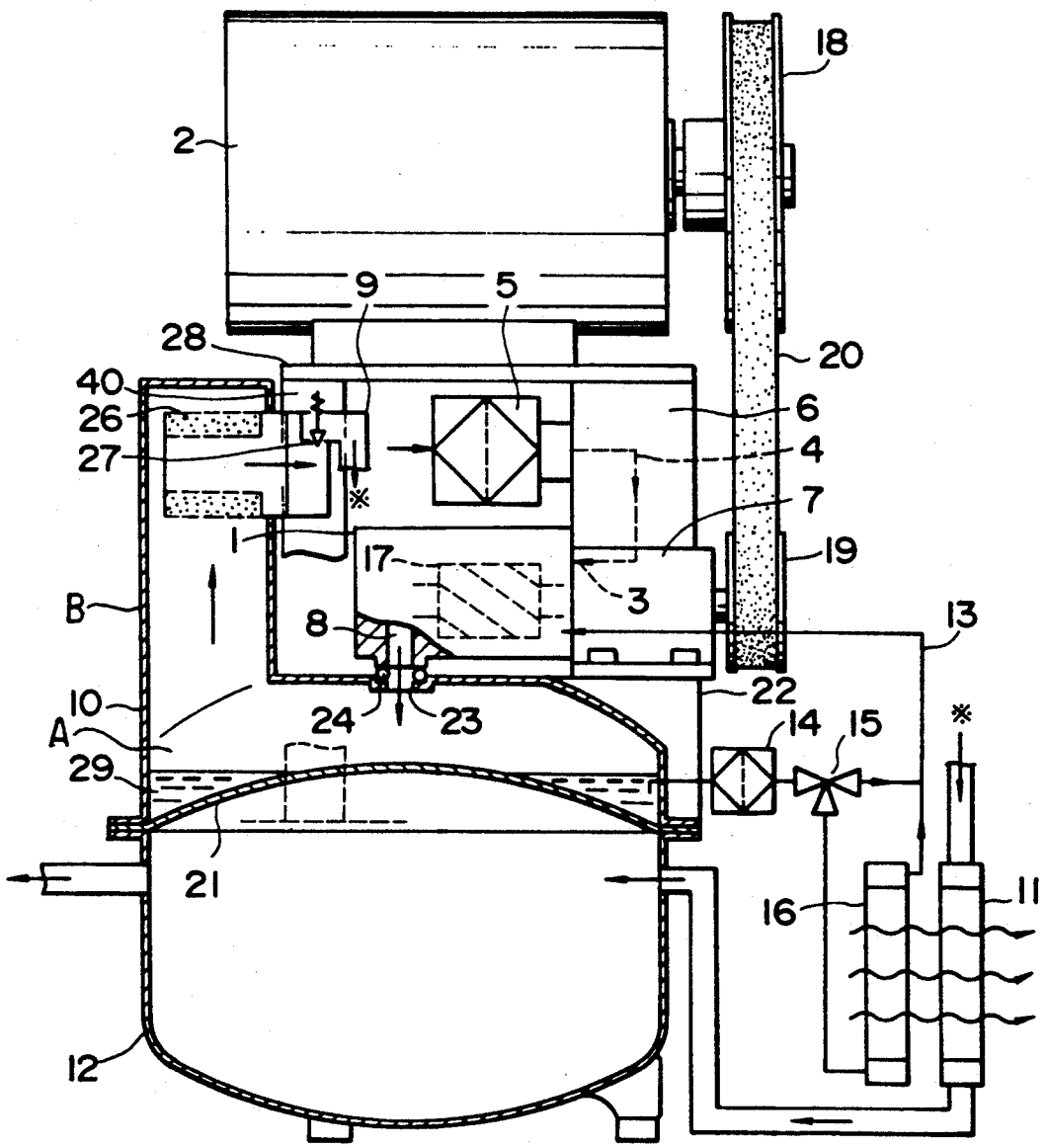
FIG. 6 is a schematic vertical sectional view of an oil injection type screw compressor according to a fifth embodiment of the present invention.

FIG. 6 shows an oil injection type screw compressor according to the fifth embodiment of the present invention. The present oil injection type screw compressor is substantially similar to the equipment according to the first embodiment shown in FIG. 1 except that a supporting portion for the support plate 28 is provided by a platform 40 provided uprightly on a peripheral portion of an upper face of the oil tank 10 in place of the oil separating portion 25, and like parts are denoted by like reference numerals and description thereof will be omitted herein.

Figure 7:
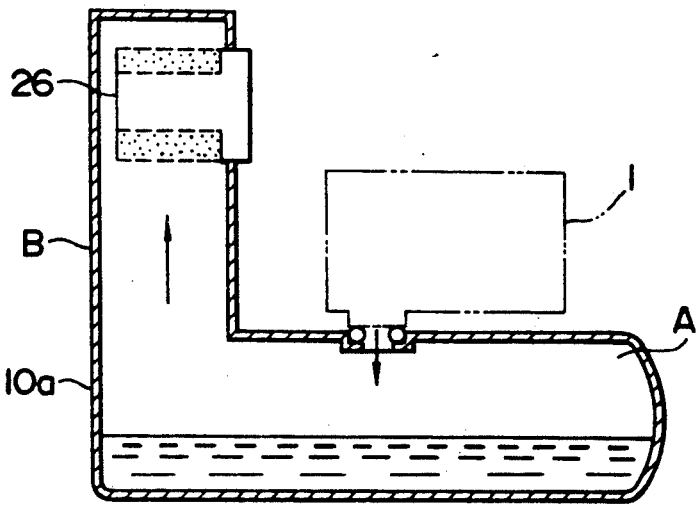
FIG. 7 is a vertical sectional view showing a modified form of an oil tank according to the present invention.

It is to be noted that, while in the embodiments described above the oil tank 10 is shown formed in an integral relationship with the reservoir tank 12, the present invention is not limited to this but includes such an equipment as shown in FIG. 7 which includes an oil tank 10*a* which is composed of a base portion A and a column portion B and is formed as an independent member having an L-shaped vertical section. In this instance, the reservoir tank 12 is provided in a suitable spacing separately from the oil tank 10*a*.

Subsequently, description will be given of an oil injection type screw compressor which employs an oil tank 10*a* of the type mentioned just above and solves such problems of prior art equipments described below.

Conventional driving mechanisms for screw compressors are generally divided into two types including a type wherein an output power shaft of a motor is coupled directly to a rotor shaft of a compressor body by way of a coupling and another type which employs a belt. Since a driving mechanism of the former type is disadvantageous in that the entire equipment is great in size, a driving mechanism of the latter type which employs a belt is commonly adopted for a screw compressor of the package type. Further, since an arrangement of a motor and a compressor body in a juxtaposed relationship with each other requires a comparatively great installation area, they are normally arranged one above the other in a screw compressor of the package type.

Figure 8:
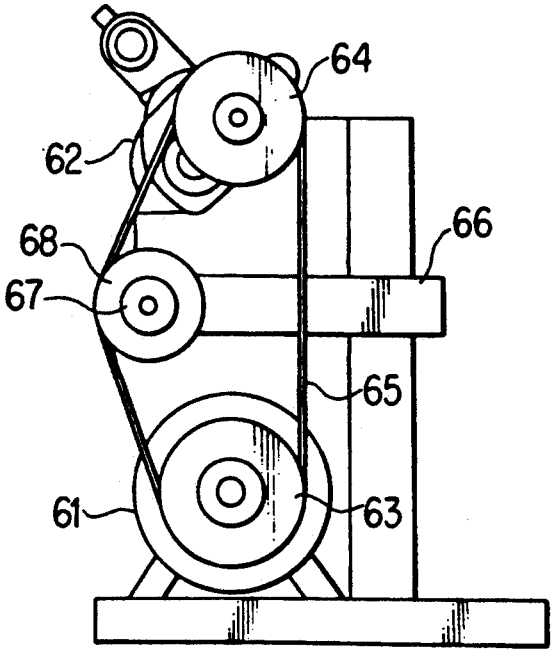
FIG. 8 PRIOR ART
FIG. 8 is a front elevational view of another conventional oil injection type screw compressor.

FIG. 8 shows a conventional screw compressor of the package type. The screw compressor shown has a generally compact arrangement wherein a compressor body 62 is disposed above a motor 61 and rotation of the motor 61 is transmitted to the compressor body 62 by way of a driving pulley 63, a driven pulley 64 and a belt 65.

Where the belt 65 is employed in this manner, it is necessary to keep the tension of the belt 65 within a fixed range in order to prevent a possible slip between the belt 65 and the driving pulley 63 or driven pulley 64. To this end, in the equipment shown, an idler pulley 68 is supported for rotation by means of a bearing 67 on a support member 66, which is mounted for movement in leftward and rightward directions by an adjusting mechanism not shown, in order to produce such tension of the belt 65.

By the way, since such conventional equipment as described above employs the idler pulley in order to produce such tension of the belt 65, not only a great number of parts for the adjustment of the tension of the belt 65 are required including a mechanism for supporting the idler pulley 68 for leftward and rightward adjustment to a suitable position, but also there is another problem that a long period of time is required for production of the equipment.

Further, since the bearing 67 is required for the idler pulley 68 and besides such a pressurized lubricating system like a lubricating system employed in the compressor body 62 cannot be employed at the location of the bearing 67, it cannot be avoided to employ lubrication by grease. On the other hand, while the portion of the equipment shown in FIG. 8 is finally accommodated in a package, since the internal temperature of such package is hither by 10° to 15° C. than a temperature around the package and the rotational speed is generally higher than the two pulleys, there are problems that the life of the grease is short and much time is required for the inspection and maintenance of the idler pulley 68.

Further, since the idler pulley 68 is employed, the number of bent locations of the belt 65 is increased, and there is a problem that the life of the belt 65 is decreased.

On the other hand, it is also possible to move, without using such idler pulley 68, the motor 61 horizontally to change the distance between axes of the compressor body 62 and the motor 61 to produce a tension of the belt 65. Such solution, however, does not produce a sufficient change of the distance between the axes with respect to a distance of horizontal movement of the motor 61, and consequently adjustment of the tension of the belt 65 in accordance with the solution is substantially impossible.

Further, it is also possible to insert, without employing such idler pulley 68, a shim (spacer) into a location of a leg mounting face for the compressor body 62 to change the distance between such axes to adjust the tension of the belt 65. According to this solution, however, the motor 61 must be lifted to loosen the belt 65, and then the compressor body 62 must be lifted to effect insertion or removal of a shim or shims. If it is taken into consideration that a hand of an operator may not readily reach an interior portion of the package, then there are problems that much time is required for such operation and besides only stepwise adjustment of the tension of the belt 65 is possible but fine adjustment cannot be achieved.

A sixth embodiment of the present invention has been made in view of such problems of the conventional equipment as described above and provides an oil injection type screw compressor of the package type by which the tension of a belt can be adjusted suitably and readily with a simple mechanism.

In order to solve the problem described above, according to the sixth embodiment of the present invention, a screw compressor of the package type wherein a driving pulley, a driven pulley and a belt are employed as rotation transmitting means between a motor and a compressor body is constituted such that the motor is secured horizontally to a front side wall of a platform below the compressor body by means of bolts extending through elongated holes formed in vertical directions in the front side wall.

Where the screw compressor of the package type is formed in such a manner as described just above, continuous adjustment of the tension of the belt can be performed from the front of the equipment making use of the weight of the motor itself without employing an idler pulley.

Figure 9:
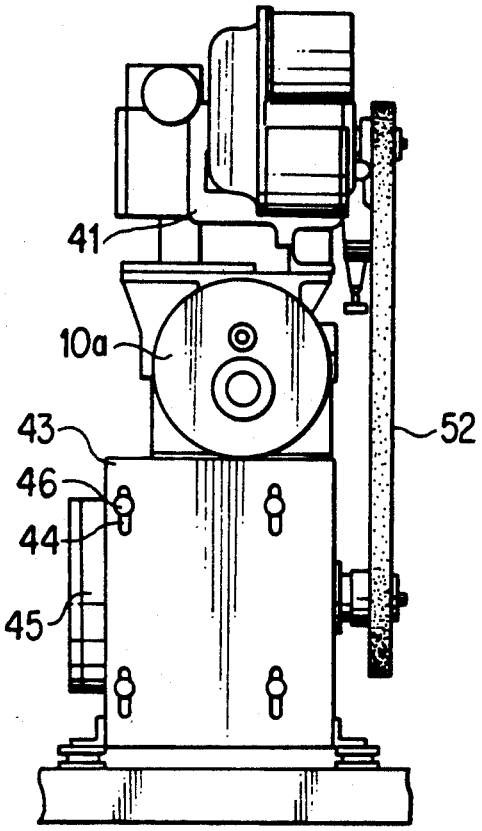
FIG. 9 is a schematic vertical sectional view of an oil injection type screw compressor according to a sixth embodiment of the present invention.
Figure 10:
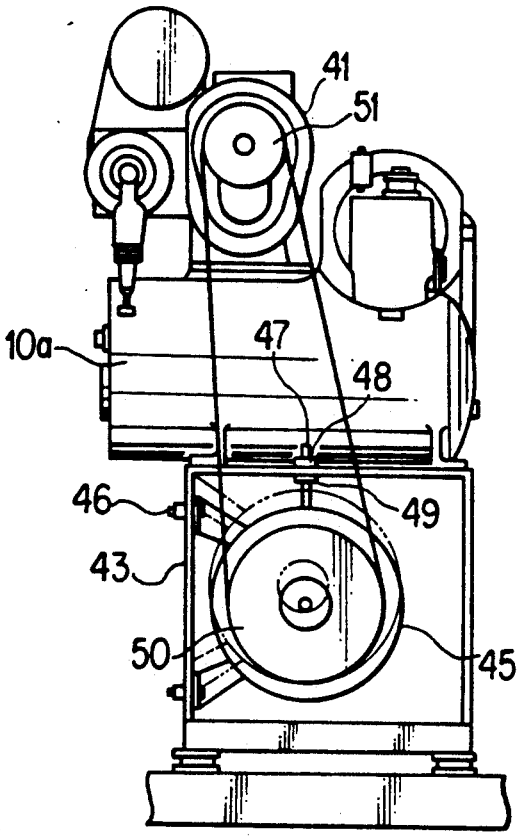
FIG. 10 is a schematic vertical sectional view of the oil injection type screw compressor according to the sixth embodiment of the present invention.

FIGS. 9 and 10 show such oil injection type screw compressor of the package type according to the sixth embodiment of the present invention. The present oil injection type screw compressor includes an L-shaped oil tank 10*a* mounted below a compressor body 41 and a motor 45 mounted in a horizontal direction on a front side wall of a platform 43 below the oil tank 10*a* by means of bolts and nuts 46 by way of elongated holes 44 formed vertically in the front side wall of the platform 43. Meanwhile, a bolt 47 extends through an upper wall of the platform 43 to the motor 45 and is supported for adjustment in upward and downward directions by means of a pair of nuts 48 and 49 located on the upper and lower faces of the upper wall of the platform 43. Further, a driving pulley 50, a driven pulley 51 and a belt 52 are provided as rotation transmitting means between the compressor body 41 and the motor 45.

Then, the compressor body 41, or more accurately a pair of screw rotors not shown in the compressor body 41, are rotated by the motor 45 by way of the rotation transmitting means to suck gas into the compressor body 41 and discharge the thus sucked and compressed gas from the compressor body 41 to the oil tank 10*a* together with oil poured into the compressor body 41 for the object of cooling or the like. Then, the compressed gas and the oil are separated from each other in the oil tank 10*a*, and the compressed gas is sent out from the oil tank 10*a* while the separated oil is stored once in the oil tank 10*a*.

Subsequently, description will be given of procedures of wrapping of the belt 52 of the equipment and adjustment of the tension of the belt 52.

First, the lower nut 49 is loosened to put the bolt 47 into a condition in which it can be lifted freely, and then the motor 45 is mounted loosely by means of the bolts and nuts 46 at a location a little lifted toward the compressor body as indicated by an alternate long and two short dashes line in FIG. 10, whereafter the belt 52 is wrapped around and between the driving pulley 50 and driven pulley 51.

Then, the upper nut 48 is loosened gradually to allow the bolt 47 to move downwardly so that the motor 56 is moved down little by little together with the bolts and nuts 46 which are moved down along the elongated holes 44. In this instance, since the direction of the gravitational force and the direction of movement of the motor are same, the force required for moving the bolt 47 down is small. Then, if a suitable tension of the belt 52 is reached at a location to which the motor 45 is moved down as indicated by a solid line in FIG. 10, then the bolts and nuts 46 are subsequently tightened sufficiently strongly to secure the motor 45 and then the bolt 47 is secured by the nuts 48 and 49 in a condition wherein it is spaced away from the motor 45, thereby completing the belt tension adjusting operation.

Since the motor 45 is secured by means of the elongated holes 44 in the front side wall of the platform 43 and the bolts and nuts 46, such operation can be performed from the front side of the equipment. While the foregoing description relates to an operation to increase the tension of the belt, a belt tension decreasing operation may be performed reversing the directions of the movements of the elements described above.

It is to be noted that, while the embodiment described just above includes the bolt 47 and nuts 48 and 49 and adjustment of the tension of the belt is performed using them, such bolt 47 and nuts 48 and 49 are not essential to the present invention, and where those elements are not provided, a force acting in an upward or downward direction can be applied little by little to the motor 45 by suitable means to gradually move the motor 45 to effect adjustment of the tension of the belt.

As apparent from the foregoing description, according to the sixth embodiment of the present invention, the L-shaped oil tank 10*a* is employed, and the motor is secured in a horizontal direction to the front side wall of the platform below the compressor body by means of the bolts by way of the elongated holes formed in the vertical directions in the front side wall of the platform.

Accordingly, in addition to the effects described hereinabove with regard to the first embodiment which are provided by formation of the oil tank 10*a* in the L-shaped profile, there is another effect that the tension of the belt can be continuously adjusted readily from the front of the equipment making use of the weight of the motor itself with a simple mechanism without employing an idler pulley.

Figure 11:
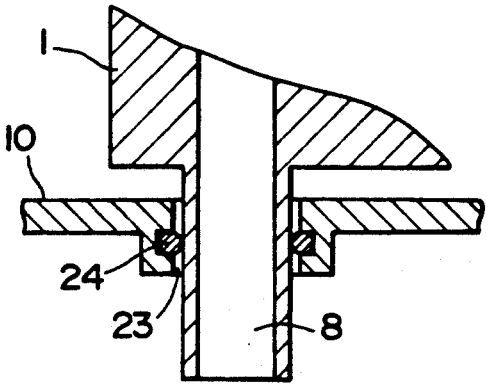
FIG. 11 is a partial sectional view of a modified form of a connecting portion between a compressor body and an oil tank according to the present invention.

It is to be noted that, while in the embodiments described hereinabove the outlet port 8 and the inlet opening 23 are located above and below the O-snap ring 24, otherwise the outlet port 8 and the inlet opening 34 for the oil tank 10 (10*a*) may be located on the opposite sides sidewardly of the O-snap ring 24 as shown in FIG. 11 such that the outlet port 8 may be pressed toward the inlet opening 23 while it remains for upward and downward sliding movement.

Further, while in the embodiments described hereinabove the compression gas is air, the present invention is not limited to this but includes an equipment wherein the compression gas is any other gas than air.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An oil injection type screw compressor comprising:

a compressor body;

an oil tank connected to an outlet port of said compressor body for separating lubricating oil from gas discharged from the compressor body and collecting the thus separated lubricating oil, wherein said oil tank has a substantially L-shaped vertical section and is composed of a base portion defining an oil storage portion, and a column portion provided uprightly on said base portion, a gas exit having an oil separating element and provided in said oil tank at an upper portion of said column portion, wherein said compressor body is disposed on said base portion, and a reservoir tank formed unitarily with and below the oil tank, including a partition plate separating said reservoir tank from said oil tank.

2. An oil injection type screw compressor according to claim 1, including a motor for driving the compressor body, a platform positioned below the compressor body, the platform having a front side wall with vertically elongated holes, and a driving pulley, a driven pulley and a belt employed as rotation transmitting means between said motor and said compressor body, wherein said motor is secured to the from side wall of the platform by means of bolts in the elongates holes.

3. The oil injection type screw compressor of claim 1, wherein said partition plate is concave.

4. The oil injection type screw compressor of claim 1, wherein said partition plate is convex.

* * * * *